United States Patent [19]

Taylor

[11] 4,175,890

[45] Nov. 27, 1979

[54] JOINTS FOR ANCHORING STRUCTURES TO THE SEA BED

[75] Inventor: Reginald S. Taylor, Gerrards Cross, England

[73] Assignee: Taylor Woodrow Construction Limited, Middlesex, England

[21] Appl. No.: 655,981

[22] Filed: Feb. 6, 1976

[30] Foreign Application Priority Data

Feb. 6, 1975 [GB] United Kingdom ..... 5189/75
Jul. 16, 1975 [GB] United Kingdom ..... 29895/75

[51] Int. Cl.[2] ..... E02D 27/04

[52] U.S. Cl. ..... 405/202; 405/207; 141/388

[58] Field of Search ..... 61/46.5, 46, 87, 94, 61/95; 114/0.5 D, 293, 264

[56] References Cited

U.S. PATENT DOCUMENTS

| | | | |
|---|---|---|---|
| 2,908,141 | 10/1959 | Marsh, Jr. | 114/293 |
| 3,522,709 | 8/1970 | Vilain | 61/46.5 |
| 3,563,042 | 2/1971 | Ryan | 61/46.5 |
| 3,710,580 | 1/1973 | Mott | 61/46.5 |
| 3,712,068 | 1/1973 | Liataud | 61/46.5 |
| 3,894,567 | 7/1975 | Mott | 141/388 |
| 3,902,447 | 9/1975 | Slocum | 114/293 |

FOREIGN PATENT DOCUMENTS

| | | | |
|---|---|---|---|
| 120311 | 9/1970 | Norway | 114/293 |

*Primary Examiner*—Jacob Shapiro
*Attorney, Agent, or Firm*—Armstrong, Nikaido, Marmelstein & Kubovcik

[57] ABSTRACT

Oil and gas extraction from deep water sites. Various structures and equipment are described, including vessels for oil/gas storage beneath the surface and/or conduction to the surface, concrete being extensively used in the construction of the structures. A joint is described that articulately connects a structure to the sea bed or to another structure.

18 Claims, 15 Drawing Figures

JOINTS FOR ANCHORING STRUCTURES TO THE SEA BED

Figure 1:
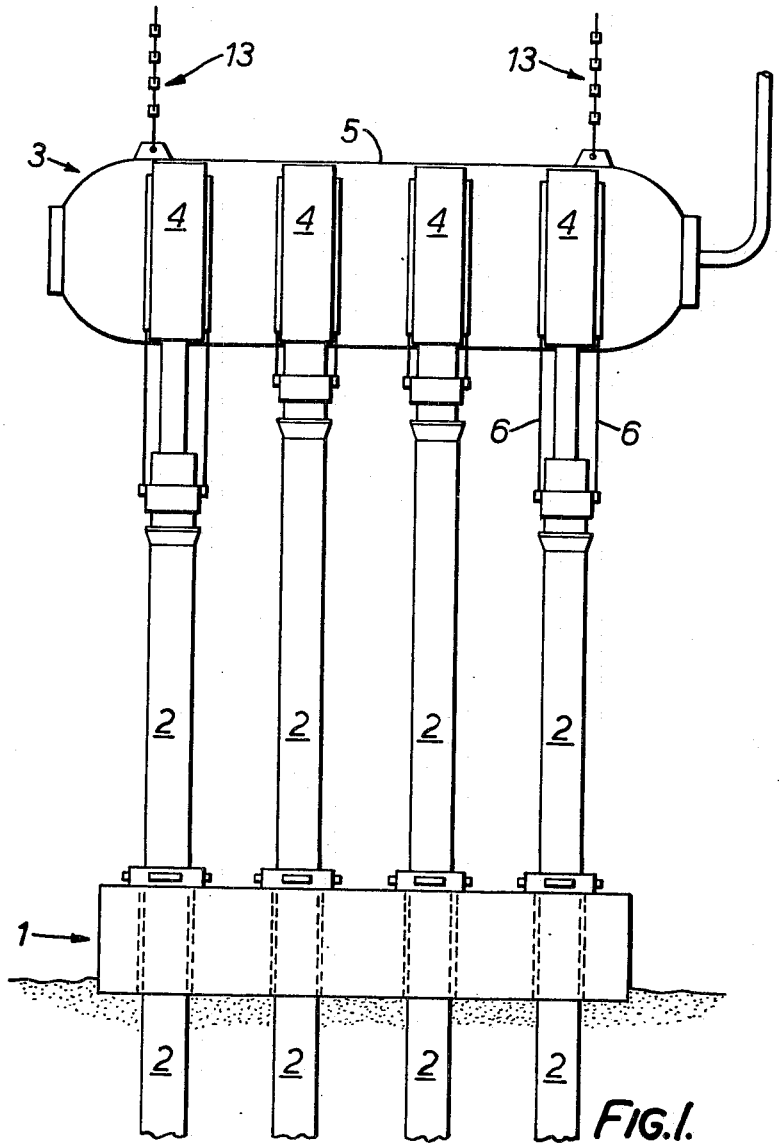

This invention relates to a joint for anchoring a structure to the sea bed, the invention being particularly concerned with the anchoring of structures to be used in connection with the extraction of oil and gas from deep water sites, such as on the edge of continental shelves and slopes, with particular respect to the North Sea and other European waters.

Hydrocarbon deposits have been found to occur in abundance under the continental shelves around the world and during the last decade the North Sea and adjacent waters have been found to overlie substantial oil and gas reservoirs. Many oil and gas fields have been and are being brought into production using existing as well as relatively new technology and these methods serve for exploitation in water depths up to approximately 200 m. However, sedimentary basins suitable for oil and gas reservoirs lie under deeper water down to depths of 3000 m. or more and there is thus a need for providing suitable and economical methods for their exploitation.

Limitations of existing or currently proposed systems mitigating against their use at depths greater than 200 m. are as follows:

Fixed Platforms—Steel high cost of fabrication and installation.

integrity dependent upon major piling systems which cannot be proof tested.

subject to corrosion problems and corrosion fatigue with attendant difficulties in maintainance and inspection.

utilise a high proportion of highly skilled labour and special steels.

do not provide oil storage facilities.

impossible to instal module packages before float out.

Fixed Platforms—Concrete limited availability of suitable deep water construction sites.

foundation problems and unsuitability for certain sea bed conditions.

massive base structure required for stability.

Floating Platforms and Semi-Buoyant Platforms

Tension—leg structures)

limited suitability for operation in northern North Sea conditions whilst possibly suitable for use at sites with a water depth greater than 200 m. there is a need to develop new and improved anchors and mooring lines.

difficulty of absorbing large movements on well flow lines, risers, etc.

disadvantage of un-protected conductor pipes.

Submerged Equipment (Sub-sea completions)

limited amount of equipment and processing plant can be installed.

reduced accessibility for control, inspection and maintenance.

problems of installation and completion of wells.

difficulties of work-over operations.

likely to be very expensive to install and operate.

require a surface platform of some kind in the vicinity.

problems of pollution control.

potentially hazardous for sub-surface operating personnel.

Articulated Columns limited amount of equipment and processing can be installed.

reliance is placed upon very large mechanical movement joints, with attendant maintenance problems.

Although the North Sea has been discussed above, the invention is applicable to deep water sites throughout the world.

According to the present invention there is provided a joint for anchoring a structure to the sea bed such that the structure can articulate; the joint comprising a first member that is to be located with respect to the sea bed, and a second member for attaching to the first member a structure to be anchored; the first and second members being connected by flexible tendons with a clearance between the members such that pivotal motion between the two members is permitted without the members coming into bearing contact.

Figure 2A:
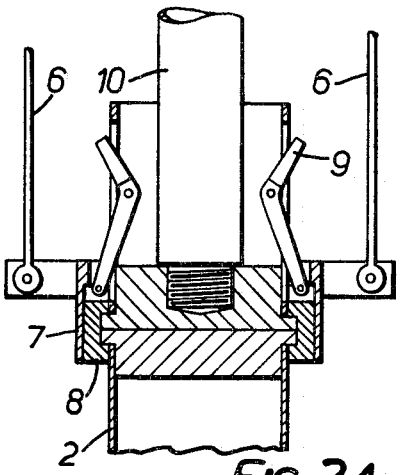
Figure 2B:
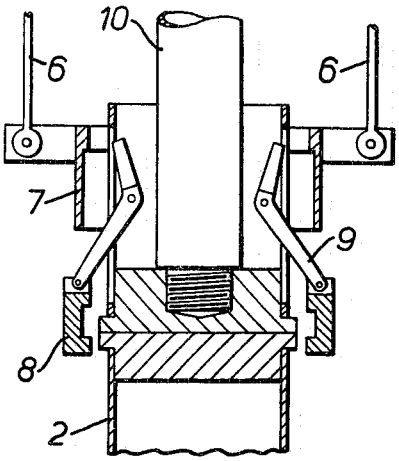
Figure 3A:
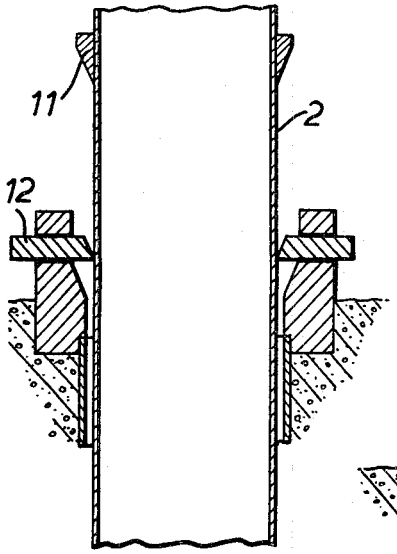
Figure 3B:
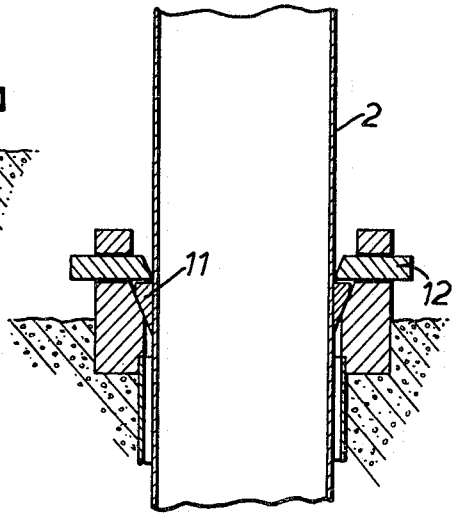
Figure 4:
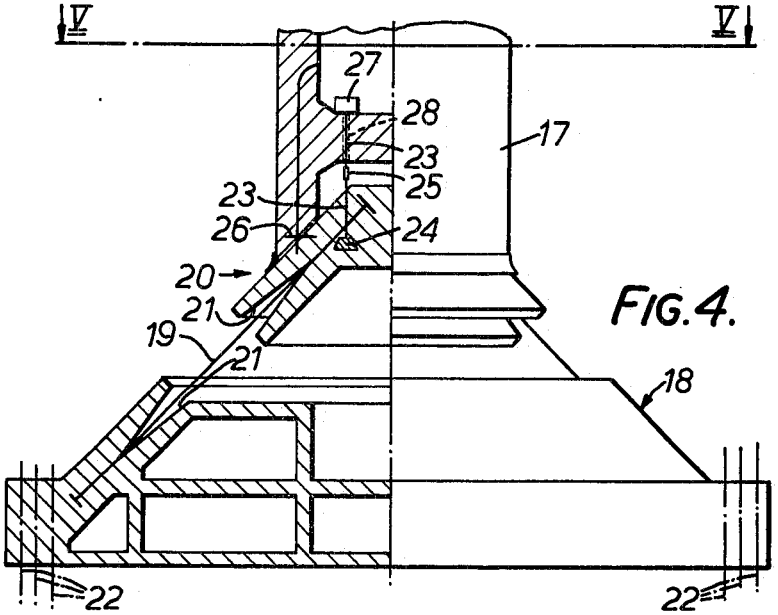
Figure 5:
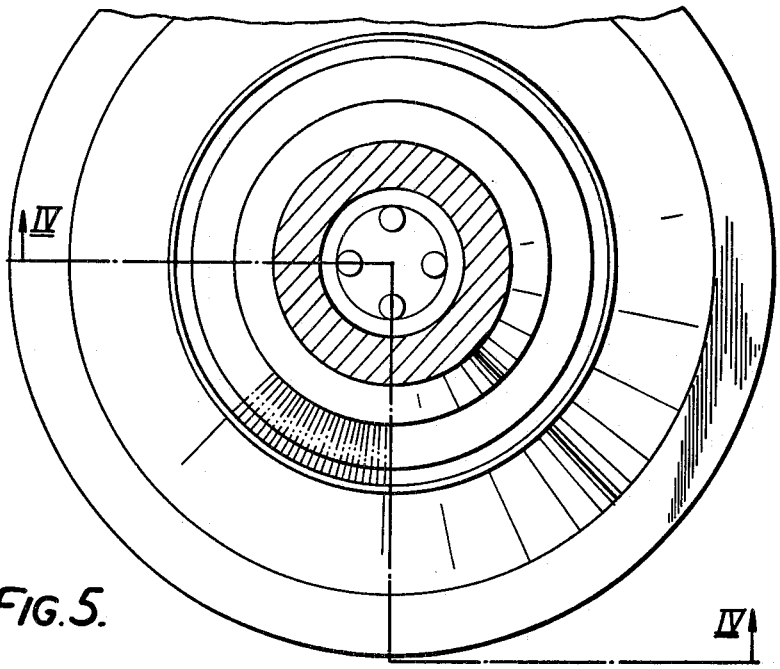
Figure 8:
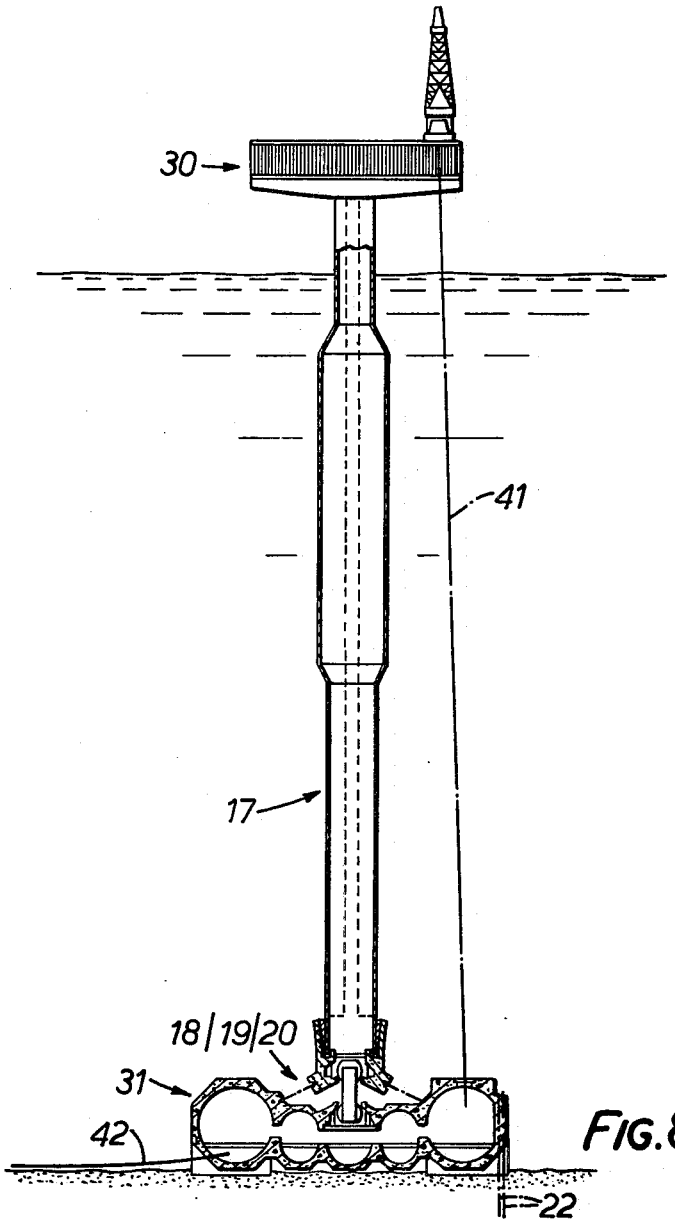
Figure 8A:
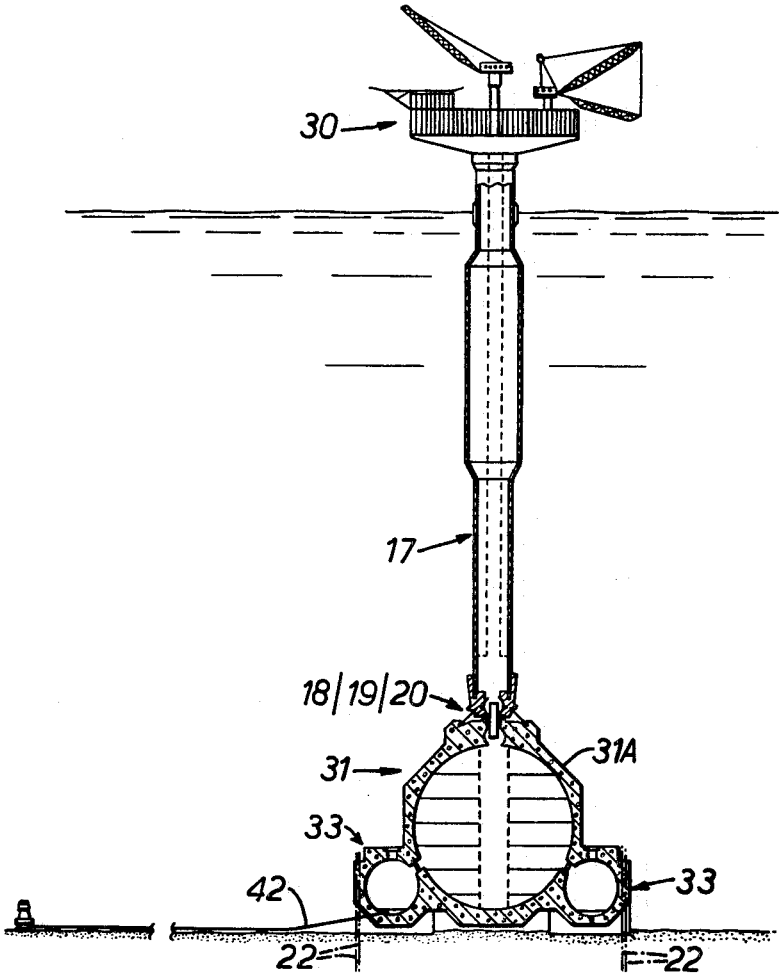
Figure 9:
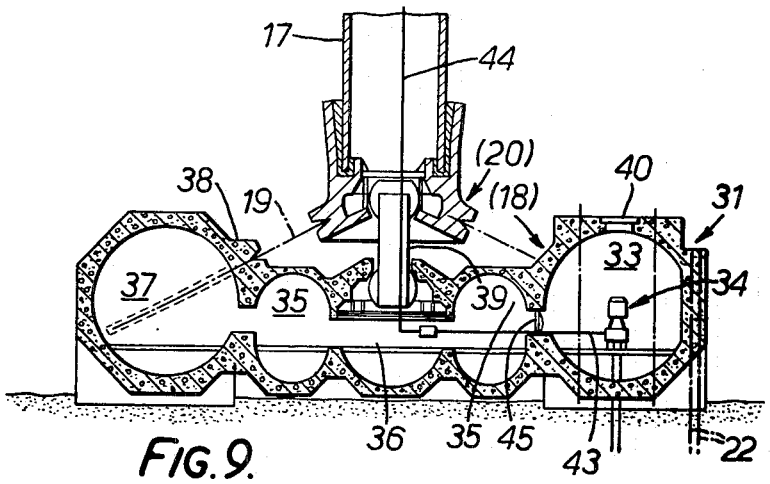
Figure 10:
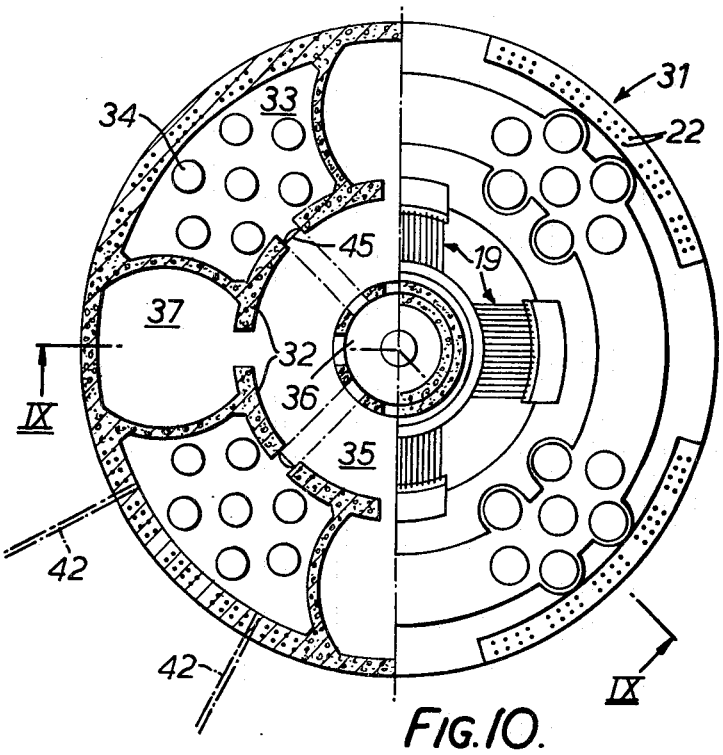
Figure 11A:
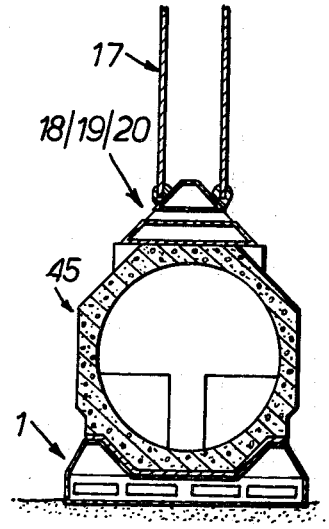
Figure 11B:
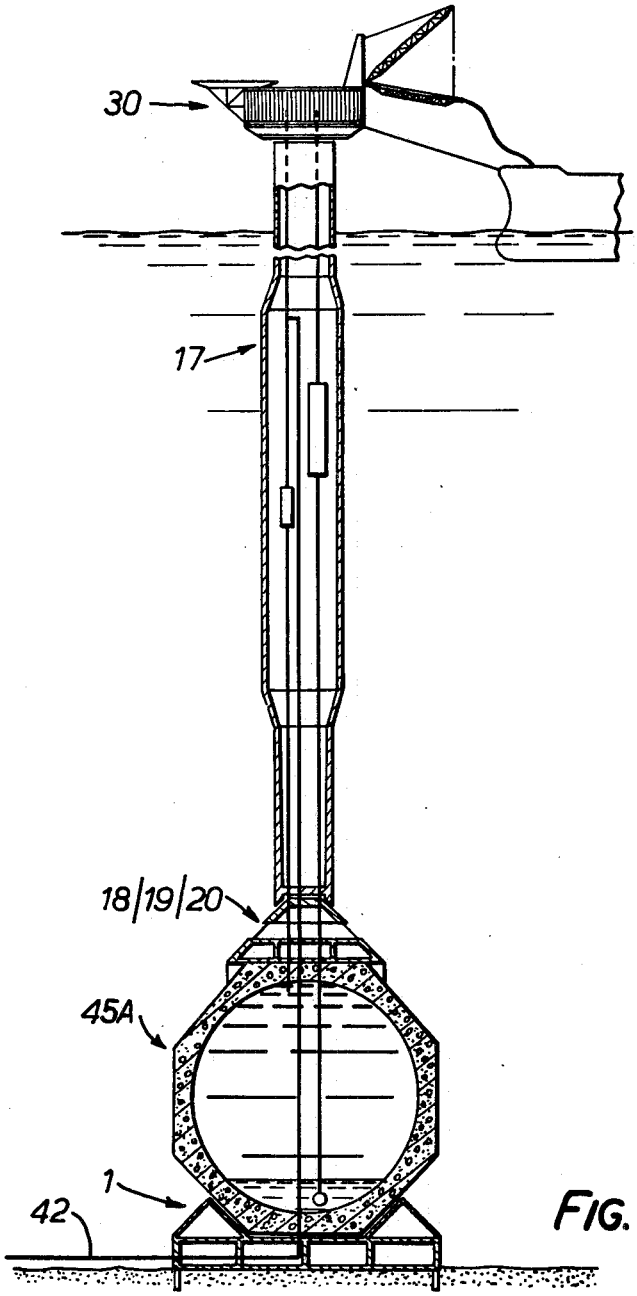

For a better understanding of the invention and to show how the same may be carried into effect, reference will now be made, by way of example, to the remaining accompanying drawings, in which:

FIG. 1 is a diagrammatic side view illustrating a member that is to be located with respect to the sea bed, and pile installing equipment for driving piles so as to locate the member, FIGS. 2A and 2B are sectional side views of a detail of the equipment of FIG. 1 shown in two different operating conditions, FIGS. 3A and 3B are sectional side views of another detail of the equipment of FIG. 1, again shown in two different operating conditions, FIG. 4 is a partly-sectioned side view of an articulating joint, taken on the line IV—IV of FIG. 5, FIG. 5 is a section taken on the line V—V of FIG. 4, FIGS. 6, 7, 8 and 8A are similar side views illustrating the joint of FIGS. 4 and 5 in combination with different forms of other structures, FIG. 9 is a sectional view of a detail of FIG. 8, taken on the line IX—IX of FIG. 10, FIG. 10 is a sectional plan view of the detail of FIG. 9 and, FIGS. 11A and 11B show various structures.

It is important to note that wherever water depths etc., are referred to herein these are only typical indications of the depths applicable, and it is probable that wide variations could, in fact, be accommodated.

Referring first to FIGS. 1, 2A and 2B, and 3A and 3B, the member that is to be located with respect to the sea bed is a prestressed concrete foundation structure 1 shown resting on the sea bed and held in position by groups of steel piles 2 driven through bores in the structure 1 by hydraulic drive equipment 3 generally of the type forming the subject of Taylor Woodrow Construction Limited's British Pat. No. 966,094, in which in driving a group of piles load is taken from driven piles of the group to a pile or piles being driven. This operation is repeated successively using different piles of the group so as to push the whole group into the ground. The piling machine of FIG. 1 includes eight large hydraulic rams 4 mounted in two side-by-side groups of four on a thick cylinder 5. The cylinder, in addition to providing structural strength and serving as a crosshead connecting the hydraulic rams can, if required, afford an atmospheric environment for operating equipment therewithin. Each hydraulic cylinder is connected to a steel tube or other structural shape which forms the pile itself and can be remotely released at the completion of the piling operation by pulling on release rods 6 (FIGS. 2A, 2B) to move a sleeve 7 upwardly first to clear a segmented locking collar 8 and then to actuate levers 9 to move the segments of the collar 8 clear of abutting flanges of the ram push rods 10 and the piles 2. As shown in FIGS. 3A and 3B, as each pile 2 reaches its intended depth a locking collet 11 thereon moves past spring-loaded locking wedges 12 carried by the structure 1, the wedges 12 then springing into a locking condition (FIG. 3B). The pile tubes pass through the prestressed concrete foundation structure 1 which rests on the sea bed, and the system can be arranged so as to drive raking piles.

An alternative configuration uses the prestressed concrete foundation structure as the structural support for the piling equipment. In this method the hydraulic rams are fixed to the piles and individually locked onto the top of the concrete block. On the completion of piling the hydraulic rams are released and recovered for further use, utilising suspension cables 13. In this case, the hydraulic equipment can be operated from a floating barge.

The advantages of providing and locating the structure 1 in the way just described include the provision of a "proof-tested" load carrying capability, the ability, if desired, to disengage the structure from the sea bed and move it to another location, remotely controlled operation and installation, flexibility in design, and also that the structure is constructed and inspected in the dry.

Installation equipment will next be described. This equipment includes guide lines for positioning the piling machine. Where a large number of piles, necessitating many re-positionings of the piling machine, have to be placed, the number of guide lines used is minimised by, in turn, remotely releasing guide lines from the anchor blocks and re-attaching them at new locations for re-use. Also the piling machine can be provided with mechanism such as hydraulic thrusters and acoustic transmitters for guiding it into position.

The installation equipment is operated from a surface vessel which is preferably a purpose made floating barge. The concrete structures 1 are constructed on shore and towed to the site on pontoons, or they are self-buoyant. On site the structures are docked and lifted by two 'portal' cranes on the barge. After removing the pontoons (if provided) each structure is lowered to the sea bed by two main hoist ropes with four guide lines attached. The position of the structure on the sea bed is checked just prior to landing and any unacceptable error corrected by moving the barge. The eight piles are then lifted into position in the well and held by a temporary jig prior to installing the piling machine and locking onto the tops of the piles. The assembly is then lowered using the guide lines until the pile tips locate into the bores for the piles in the structure. Using the dead weight of the equipment each pile is pushed a limited distance into the sea bed and the piling operation is then continued by pushing one pile at a time. When all the piles have been fully driven and located on the top of the structure the piling machine is remotely released and recovered by the barge to enable the whole operation to be repeated.

When the equipment is used to provide a tension pile system the flanges on the piles are pushed into contact with the metal bearing surfaces connected to the liners of the bores in the structures. The tensioned cable is anchored in the structure itself. In the case of a compression pile system, on the completion of driving the piles are locked into the structure by spring loaded locking wedges, and the annular spaces are grouted solid.

The size and lengths of piles used are selected based upon the requirements for a wide range of possible sea bed conditions typical of, but not limited to, North Sea conditions. In these, overconsolidated clays, with up to 60 $t/m^2$ cohesive shear strength and hard dense sands with angles of internal frictions up to 45°, have to be considered. In the configuration described above the length of the piles can be varied beforehand to suit a particular requirement but not during the actual piling operations. However, it is envisaged that the system could be modified to enable additional lengths to be added during the piling operation. An alternative arrangement would be to bore or jet out the piles and push smaller piles through these to an increased penetration. It is to be noted that the structure 1 is installed and the piles driven remotely from a surface vessel. No manual intervention, or rigid guides from the surface are required and the use of massive pile hammers is eliminated. A principal advantage of the system is that a "proof-loading" in both tension and compression is clearly established for each pile, and permanent load bearing capacities determined with a high level of confidence.

Referring next to FIGS. 4 and 5, the articulating joint therein illustrated is for deep water articulated columns. The joint does not rely on mechanical pins or similar universal joint type mechanisms. The principle of this joint is the use of tensioned cables to provide completely flexible or moment resistance type connections. The construction of the joint is such as to provide the possibility of incorporating means of access for men, plant and materials through the joint at atmospheric pressure.

The joint is utilised to provide an articulated connection of a column described hereinafter to the sea bed. An articulated column, pivoting at the sea bed, has already been foreseen as an attractive structure for operation in intermediate water depths of between 200 m and 500 m. The main principle of an articulated column is to permit motion in sympathy with that of the surrounding water, resulting in a substantial reduction in the forces and moments attracted to it. Its effectiveness therefore depends upon the effectiveness of the joint or "hinge" at the column base.

In other published concepts mechanical "universal" type joints have been proposed. These must rely for their efficiency on the rotation of bearing and continuous sliding low friction mating surfaces. Whilst such joints may be shown to be feasible, they will necessarily be extremely large for the deeper structure and demand an excess of high cost skill in their development and manufacture. Their viability with respect to durability, serviceability and in-service maintenance is questionable.

The present joint is based upon the following objectives:

(i) The use of "lower technology" principles, both commensurate with the environment and already proven at a scale which permits reasonable extrapolation.

(ii) The avoidance of relative moving parts requiring high technology and precision in manufacture, and with sophisticated in-service maintenance aspects.

(iii) The provision for in-service inspection and possibly replacement of critical components, but generally having a low serviceability requirement.

The principle of the present joint is that the base of the column 17 which it connects to the sea bed is held in location by radially disposed tension cables. A typical configuration is shown in diagrammatic form in FIGS. 4 and 6 based upon calculations for a column operating in 500 m water depth.

In principle, the joint consists of a lower concrete ring beam 18 connected by a series of radially disposed inclined terylene tendons 19 to an upper conical concrete "hub" 20. The base of the articulated column 17 connects integrally with the hub 20, which is located sufficiently clear of the ring beam 18 to permit maximum pivotal motion without the hub and beam coming into bearing contact.

Under the action of environmental loads on the column, the tendons permit full pivoting at the base whilst resisting the resultant shear force. Bending stresses developed in the tendons are limited to acceptable levels by radiused fairleads 21 within the hub and ring beam. The column is designed to have sufficient excess buoyancy to maintain the tendons in a state of normal tension throughout the range of motion which, in the extreme storm conditions, would give an angular displacement of 7°-9°. At 500 m depth variations in vertical force would be small. The horizontal shear forces, transmitted through the tendons would be resisted by the ring beam, which as illustrated is in essence the structure 1 of FIG. 1, that is it is piled in position in the manner already described. Alternatively it can be a gravity base. It is to be noted that:

(a) Whilst the tendons must be designed not to exceed a limiting cycle stress from fatigue considerations, the proportion of stress resulting from shear, direct tension, and pivoting can be varied by selection of component dimensions.

(b) By anchoring tendons to the central hub at two or more levels, they can be made to generate a moment-/rotation. This may significantly reduce column steady state angles with consequent buoyancy savings, whilst limiting the extreme moment to within that acceptable to the column base section, and which may have been designed from other considerations. This facility of interplay between the root moment of the column and angular displacement, does not exist with mechanical joints, and could be important for columns operating in shallower depths, where angular displacements are larger.

(c) The possibility exists of creating a central penetration through the joint, which presents the opportunity to obtain dry access via the column to subsea facilities operating at one atmosphere.

The ring beam and hub can be manufactured in normal reinforced and/or prestressed concrete at a quality suited to marine application. The tendons are manufactured from a high strain capability material, for example "PARAFIL" or similar proprietory material. "PARAFIL" is an alkathene encased terylene tendon with a tensile capacity 50% of that of prestressing steels, but with an advantageously low modulus of elasticity. The material has been developed and used for marine application, and has already undergone considerable proving. In the present usage it is considered to operate at a maximum stress in extreme conditions of only 30% of its minimum tensile strength, so allowing for anchorage efficiency, etc.

The ring beam and hub are constructed at a coastal site and preassembled with the tendons. These are preset at the required nominal direct tension by a subsequently removable jacking arrangement acting between the ring beam and the hub. The units can be either solid or cellular concrete with minimum negative buoyancy, and are towed to site using specially constructed, recoverable buoyancy aids.

Figure 6:
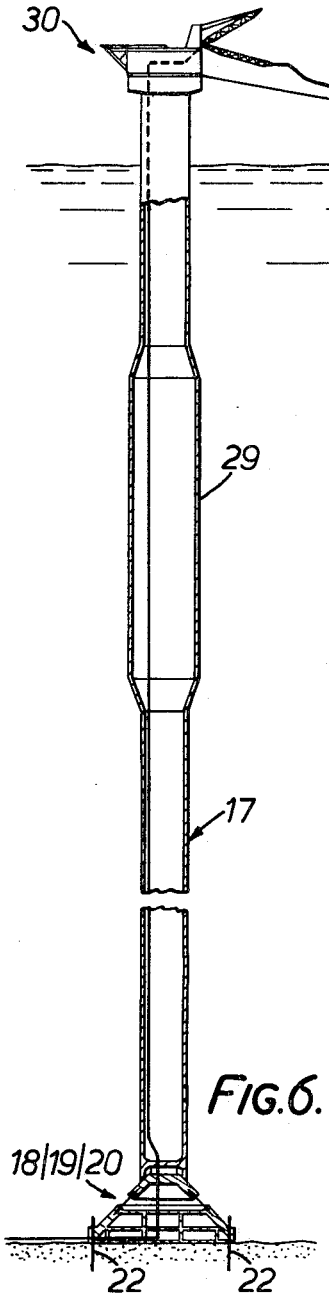
Figure 7:
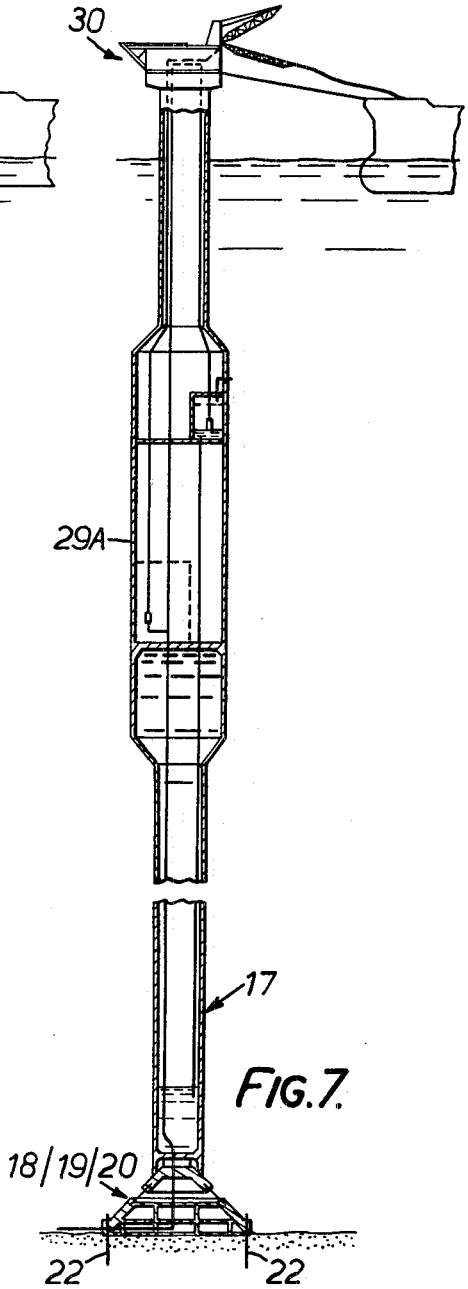

On location, the joint assembly is lowered from the buoyancy unit via cables to the sea bed. Depending upon the configuration chosen, the ring beam is then either piled-in (preferably in the manner already described), or ballasted to provide an adequate gravity base. In FIGS. 4 and 6 and 9, where the ring beam constitutes a prestressed concrete foundation structure as described with reference to FIGS. 1, 2A and 2B, and 3A and 3B, piles are diagrammatically shown at 22. The buoyant, column 17, in stable vertical orientation is guided by wire lines on to the nose of the conical hub, and prestressed to act integrally with the hub, using conventional steel tendons 23 (FIG. 4). The method of making this connection is shown in FIG. 4. In this method, anchorages 24 for the steel tendons 23, with connectors 25 attached are already located in the hub 20. After completing an elastomer seal 26, the cavity between the column 17 and the hub 20 is pumped dry and pressure caps 27 over tendon ducts 28 in the column 17 are removed following which tendons 23 are installed and stressed in the dry, and the cavity is grouted up. Finally the temporary jacking arrangement tensioning the terylene tendons 19 in the joint is removed, and the column buoyancy takes over, this being provided to a major extent by a buoyancy tank 29. An alternative method of fixing the buoyant column to the hub of the joint is to grout the column into a sleeve constructed integrally with the hub. In a further alternative the cables taper downwardly and inwardly from a raised ring beam to support the foot of the column below the ring beam, the column having in this case a small negative buoyancy.

The articulated column can take various forms. In all cases the column constitutes a fixed facility for water depths generally in the range of 200 M to 500 M, and can provide oil storage and/or vessel mooring and offloading facilities with some production facilities if required. Oil storage where provided would be in the order of 500,000 barrels. In one form the column is a prestressed concrete column being a cylindrical structure with integral buoyancy chambers. As shown in FIG. 6, the column 17 is primarily a loading facility for tankers and is provided with the mooring and loading equipment, on a deck superstructure 30, necessary to provide for offshore loading from an oil field which may not be served by a pipeline. The column is in this case at atmospheric pressure and serves to carry the various flow-lines from the production unit. Operating water depths of up to or even greater than 500 M are possible. There is no provision for oil storage.

As shown in FIG. 8, the column such as shown in FIG. 6 (or it could be in the form of FIG. 7) is connected by the joint 18/19/20 to a housing 31 on the sea bed. In all these combinations the basic concern is with mooring, loading and storage. However, the same general combination of components can be used to provide other facilities such as support for a flare-stack. There is always a need for some flaring, however small, and where sub-sea production methods are employed a separate flare stack is required. Even in cases where the production facilities are surface mounted it is often desirable to provide a flare unit well separated from the production area and the articulated column structure is ideal for this purpose.

The column, manufactured in prestressed concrete of a quality suited to the marine environment, is constructed at a coastal site in the horizontal orientation. The major portion of its length is self-buoyant, but additional buoyancy aids are required to support the lower sections when afloat. The structure's stability during float-out and installation is not sensitive to small load variations and can incorporate a significant proportion of installed plant. On location, the column is set up into the vertical position by controlled guying from external buoyancy aids and possible additional ballasting.

Guide lines already positioned on the previously placed joint and held at the surface on buoys, are used to guide the column to the joint nose and connection effected as already described.

Referring again to FIG. 8, and to FIGS. 9 and 10, the housing 31 is constructed to house the well heads of so-called "subsea completions" that are utilized in the extraction of oil and gas, the housing containing chambers for housing subsea completions and that can be maintained substantially at atmospheric pressure to permit man-access to such completions. As indicated above, the housing also serves as a foundation member for the whole assembly.

The housing 31 is a prestressed concrete member which is constructed to have with additional aid if required, buoyancy and stability for towing from its place of construction to its intended offshore location, where it is submerged to the sea bed. The housing 31 then either rests on the sea bed under the effect of gravity, or (and as illustrated) is held by piles 22 driven through passageways provided in the housing 31 and into the sea bed, piling being effected in the manner described above.

The housing 31 has defined within it by walls 32 chambers for various purposes. These chambers include chambers 33 for providing buoyancy and stability during floatation and that are flooded for submerging, these chambers also serving for housing well heads 34 of subsea completions; chambers 35 for housing plant and/or oil storage and providing passageways for oil/gas flow ducts from the subsea completions; a central chamber 36 from which the chambers 35 radiate; and (where the housing 31 is to form, as illustrated, part of an assembly in which the column 17 is held to the housing 31 by the joint 18/19/20) chambers 37 giving access to anchorages of the tendons 19 of the joint. Such chambers can also be provided at the base of the column 17. Tendons can be replaced by drawing them into the housing 31.

The tendons 19 extend in four radially-spaced apart groups from individual lower anchorages in a circular rib 38 on the upper surface of the housing 31, upwardly and inwardly to individual upper anchorages around the hub 20. The adoption of four groups of tendons gives a tendon geometry such that no tendon is in line with a subsea completion chamber 33, thus facilitating access to the lower tendon anchorages from the chambers 37.

The interior of the housing 31 is connected to the interior of the column 17 by an access shaft 39 that is disposed centrally of the tendons 19, and that passes through seal assemblies between the shaft and the housing 31, and between the shaft and the hub 20.

One manner of utilising the equipment just described is to submerge the housing 31 with the joint 18/19/20 fitted thereto at a desired off-shore location, and install the piles 22. With hatches 40 in the tops of the subsea completion chambers 33 open, wells are drilled from a drill ship with the drill shafts passing through the accessways provided by opening the hatches, and through bores in the bases of the chambers 33. Once the wellheads 34 have been installed, the column 17 is floated into position and lowered to connect to the hub 20 of the joint, and this connection made good. The deck superstructure 30 is then erected.

As an alternative, well drilling can be carried out after installation of the column 17 and the deck superstructure 30, with the wells being drilled in the manner just described but from the deck. In FIG. 8 a drill string 41 operated from the deck is shown.

A plurality of subsea completions can be housed in each chamber 33, and in addition provision can be made for drawing into the chambers 33 through normally sealed access ports flowlines 42 from subsea completions disposed externally of the housing 31.

Flowlines 43 from the well heads 34 are connected to risers 44 that run up the column 17. Articulated connections to give a three-joint system may be provided in each run of flowline 43/riser 44. In normal operation, the hatches 40 are closed, but the chambers 33 are flooded, whilst the remaining chambers to which access is required, or which contain plant, are operated at atmospheric pressure. If it is desired to gain access to the chambers 33 they are de-watered, and bulkhead doors 45 to the chambers 33 are opened. The hatches 40 are lifted off in the event of a well "blow-out" or abnormal pressure occurring so that the structure of the housing 31 is not excessively loaded.

All flowlines, control lines and other connections are made through bulkheads, and all bulkhead closures are provided with two separate sealing arrangement.

FIG. 8A shows an alternative form of the housing 31 in which a central part 31A is of a form described below with reference to FIG. 11A, but having chambers 33 as just described around it.

Further structures which are for operating beneath the sea will now be described with reference to FIGS. 11A and 11B.

Referring first to FIG. 11A, a vessel 45 is rigidly fixed to the sea bed, mounted on a composite or pre-installed foundation 1 that can be piled to the sea bed as already described. An articulating column 17 as already described is connected to the vessel 45 by the described joint 18/19/20 constructed to permit atmospheric access therethrough. Such access can be supplemented by a capsule docking system. The vessel 45 can be considered for water depths of up to 350 m, being a concrete sub-sea vessel designed for the one atmosphere enclosure of production equipment at considerable depth below the water surface and based upon nuclear prestressed concrete pressure vessel technology. The vessel is particularly suitable where the system is used in connection with sub-sea completions.

The vessel 45 is a large concrete structure always experiencing, in operation, a general compressive field stress and having a spherical internal avoid which can be used as a production area, which is economically attractive, and results in a substantially uniform stress regime. The operational loading is ideally suited for such a structure since it derives substantially from the hydrostatic water pressure imposed as it is submerged to its working depth, and it gives rise to more or less uniform compression in the walls of the structure. For a typical depth of 200 m, a substantially uniform compressive stress level of 11 $N/mm^2$ is obtained and this uniform state is in the main disrupted only by the lateral wave forces and by the local loads and moments applied by the tower or column. The lateral wave forces can reasonably be assumed to be sinusoidally distrubuted in plan, and they only affect the field stress levels by approximately $\pm 2.0$ $N/mm^2$. The local stress disruptions arising from the tower are in the order $\pm 8$ $N/mm^2$.

The 11 $N/mm^2$ compressive field stress, which is a satisfactory working level, is based on a minimum wall thickness of 4 meters. This wall thickness is in turn derived from empirical formulae based on results from long term implosion tests on concrete spheres and which takes account of ultimate load requirements. The only steel required will be relatively small quantities of prestressed steel and normal reinforcement to take account of local effects.

In construction, the foundation structure where separate is pre-installed as previously described and the vessel is then lowered from a construction ring or buoyancy raft to connect firmly with the foundation structure.

Referring to FIG. 11B, the vessel 45A herein illustrated is for the storage and loading of oil in deep water and is suitable for water depths up to approximately 350 m, although greater depths could be possible. The vessel 45A is similar to the vessel 45 of FIG. 11A, carrying an articulated column 17 which extends to the surface where it carries a deck superstructure or platform 30, and resting on a concrete structure 1 which is rigidly fixed to the sea bed. The use of the articulated column carrying a platform near the surface reduces overall horizontal forces. Since man-access into the vessel 45A is not required, (and hence the vessel is thus able to operate in water depths up to 500 m) it is not necessary that the joint 18/19/20 should in this case permit man-access. An oil storage capability in excess of 1 million barrels is envisaged.

In summary, the vessels 45, 45A are intended for water depths in the general range of 300 m to 500 m, but the system should be usable in appreciably greater depths. They enable crude oil to be processed either from satellite sub-sea completion systems or from conventional well conductors, or both. The basic principle is to minimise the movements caused and the forces exerted on the principal parts of the structure by waves, current, and wind by placing the bulk of the facilities at a depth where such forces are significantly lower than at, or in the vicinity of, the sea surface. All manual operations are carried out at atmospheric pressure, and similarly atmospheric access from the surface is provided for men, plant and materials. The principle extends present technology, so far as oil storage is concerned, into deeper water. Storage volumes of 1 million bbls and over are possible, operating on the water displacement principle with the vessel 45 or 45A always being full of either oil or water or both. The oil being lighter will float on the water. Deep well pumps are provided to enable oil or water to be pumped in or out as required. The displacement water is passed through separators before being discharged to the sea. In order to ensure complete tightness against oil leakage the oil/water balancing system is arranged so as always to provide a precompression in the vessel by the external hydrostatic pressure.

A construction and installation procedure is as follows. The outer skin of the base part of vessel is constructed in a predredged dry cofferdam. This is surrounded by a floatable circular reinforced concrete raft, which forms a construction "ring" or raft. A buoyant reinforced concrete base is also constructed in the cofferdam and is preinstalled before the vessel is towed to site. The cofferdam is flooded and breached so that the raft and partly constructed vessel with its base can be removed to a Stage 2 position. The raft then serves as a construction base until completion of the structure. It is also required as a stability aid during the latter stages of construction. This is accomplished by a system of guylines connecting the vessel to the raft, with the whole configuration maintained rigid by the tension in the guylines. This arrangement can also be used to limit construction and tow-out draughts, utilising the extra buoyancy provided by the raft.

When the vessel has been towed to its final location it is lowered from the buoyant circular enclosing raft to make contact with the preinstalled foundation to which it is then rigidly attached.

I claim:

1. A joint for anchoring a structure to the sea bed such that the structure can articulate; the joint comprising a first member that is to be located with respect to the sea bed, and a second member for attaching to the first member a structure to be anchored; the first and second members being connected by flexible tendons with a clearance between the members such that pivotal motion between the two members is permitted without the members coming into bearing contact, wherein said tendons are attached to one of the members at two or more levels.

2. A joint as claimed in claim 1, wherein, in use, said tendons are disposed in tension in mutually inclined relationship.

3. A joint as claimed in claim 2, wherein the tendons radiate from the second member to the first member.

4. A joint as claimed in claim 3, wherein the zone at which the tendons are connected to the second member is, in use, above the zone at which the tendons are connected to the first member.

5. A joint as claimed in claim 4, wherein an accessway from one member to the other is provided between the tendons, this accessway being sealed to both the members.

6. A joint as claimed in claim 1, wherein the tendons are anchored in the members so as to be releasable for replacement.

7. A joint for anchoring a structure to the sea bed such that the structure can articulate; the joint comprising a first member that is to be located with respect to the sea bed, and a second member for attaching to the first member a structure to be anchored; the first and second members being connected by flexible tendons with a clearance between the members such that pivotal motion between the two members is permitted without the members coming into bearing contact, wherein tendons are anchored in the members so as to be releasable for replacement, wherein one of the members is provided with means of access from its interior to anchorages of the tendons for releasing the tendons for replacement.

8. A joint as claimed in claim 1, wherein the members are of reinforced and/or prestressed concrete.

9. A joint for anchoring a structure to the sea bed such that the structure can articulate; the joint comprising a first member that is to be located with respect to the sea bed, and a second member for attaching to the first member a structure to be anchored; the first and second members being connected by flexible tendons with a clearance between the members such that pivotal motion between the two members is permitted without the members coming into bearing contact, wherein the tendon material is alkathene encased terylene.

10. A joint for anchoring a structure to the sea bed such that the structure can articulate; the joint comprising a first member that is to be located with respect to the sea bed, and a second member for attaching to the first member a structure to be anchored; the first and second members being connected by flexible tendons with a clearance between the members such that pivotal motion between the two members is permitted without the members coming into bearing contact, having said structure fast with said second member, said structure being a column extending to above water level in use, for use at a site where oil or gas is to be extracted from under the sea bed, the column being provided with risers for carrying oil or gas to the surface, and accommodation for oil storage plant equipment, a flare stack unit, or joint tendon access and replacement facilities.

11. A joint as claimed in claim 10, wherein the column is provided with vessel mooring and loading equipment.

12. A joint as claimed in claim 10, wherein the column is of prestressed concrete.

13. A joint as claimed in claim 10, wherein said first member is fast with an underwater housing that is disposed on the sea bed in use.

14. A joint as claimed in claim 10 for use at a site where oil or gas is to be extracted from under the sea bed, the column being provided with risers, wherein an accessway from one member to the other is provided between the tendons, this accessway being sealed to both the member; and wherein said housing has chambers within it said chambers being at, or capable of being placed at, atmospheric pressure.

15. A joint as claimed in claim 14, wherein said housing has within it chambers that give access to anchorages of the tendons of the joint for the purpose of replacing these tendons.

16. A joint as claimed in claim 14, wherein the chambers for housing well heads have removable hatches which, when removed, permit drill shafts to be passed into and through the chambers and through bores in the bases of the chambers.

17. A joint as claimed in claim 13, wherein said housing is of prestressed concrete.

18. A joint for anchoring a structure to the sea bed such that the structure can articulate, comprising two members connected together by flexible tendons such that when the tendons are in tension the two members are held in a closely adjacent, superposed relationship with a clearance between the two members sufficient to permit pivotal motion between the said members without the members coming into bearing contact, wherein the tendons are formed of synthetic plastics material of a strain capability such that during such pivotal motion all the tendons remain in tension and wherein a first member of the two members is adapted for location with respect to the sea bed and the second member of the two members is adapted for attachment to the first member of a structure that is to be anchored.

* * * * *